US007319433B2

(12) United States Patent
Rosenberg et al.

(10) Patent No.: US 7,319,433 B2
(45) Date of Patent: Jan. 15, 2008

(54) WIDEBAND ANTENNA DEVICE WITH EXTENDED GROUND PLANE IN A PORTABLE DEVICE

(75) Inventors: Johan Anton Eduard Rosenberg, Ed Dwingeloo (NL); Johannes Lucas Schreuder, Ae Borger (NL); Tjapko Uildriks, Tr Anderen (NL)

(73) Assignee: Sony Ericsson Mobile Communications AB, Lund (SE)

( * ) Notice: Subject to any disclaimer, the term of this patent is extended or adjusted under 35 U.S.C. 154(b) by 0 days.

(21) Appl. No.: 10/517,902

(22) PCT Filed: Jun. 11, 2003

(86) PCT No.: PCT/EP03/06109

§ 371 (c)(1),
(2), (4) Date: Dec. 15, 2005

(87) PCT Pub. No.: WO03/107473

PCT Pub. Date: Dec. 24, 2003

(65) Prior Publication Data

US 2006/0109182 A1 May 25, 2006

Related U.S. Application Data

(60) Provisional application No. 60/407,886, filed on Sep. 3, 2002.

(30) Foreign Application Priority Data

Jun. 13, 2002 (EP) ..... 02013085
Aug. 26, 2002 (EP) ..... 02018940

(51) Int. Cl.
*H01Q 1/24* (2006.01)

(52) U.S. Cl. ..... 343/702; 343/866; 343/846; 343/741

(58) Field of Classification Search ..... 343/702, 343/700 MS, 741, 866, 829, 846–849
See application file for complete search history.

(56) References Cited

U.S. PATENT DOCUMENTS 5,020,136 A 5/1991 Patsiokas et al. ..... 455/89
5,408,699 A * 4/1995 Yamashita et al. ..... 455/274
6,175,334 B1 * 1/2001 Vannatta et al. ..... 343/702

(Continued)

FOREIGN PATENT DOCUMENTS

WO 01/76006 10/2001

OTHER PUBLICATIONS

International Search Report for PCT/EP03/006109, Nov. 18, 2003.

*Primary Examiner*—Douglas W. Owens
*Assistant Examiner*—Tung X Le
(74) *Attorney, Agent, or Firm*—Myers Bigel Sibley & Sajovec, P.A.

(57) ABSTRACT

An antenna device for a portable device has an antenna loop of conducting material to be connected to radio circuitry in the portable device. The antenna loop is positioned opposite a ground plane of a PCB. Also, the antenna device also comprises at least one battery, which is positioned in the extension of a first side of the PCB, and acts as an extension of the ground plane of the PCB.

20 Claims, 4 Drawing Sheets

U.S. PATENT DOCUMENTS 6,184,836 B1 * 2/2001 Ali ..... 343/702
6,204,817 B1 * 3/2001 Edvardsson ..... 343/702
6,236,368 B1 * 5/2001 Johson ..... 343/702
6,252,561 B1 * 6/2001 Wu et al. ..... 343/866
6,266,019 B1 7/2001 Stewart et al. ..... 343/702
6,329,960 B1 * 12/2001 Andrew et al. ..... 343/846
6,344,833 B1 * 2/2002 Lin et al. ..... 343/846
6,721,611 B2 * 4/2004 Schneider et al. ..... 700/84
6,765,537 B1 * 7/2004 Apostolos ..... 343/741
2002/0093455 A1 * 7/2002 Einat ..... 343/702
2002/0135523 A1 * 9/2002 Romero et al. ..... 343/741
2005/0275591 A1 * 12/2005 King et al. ..... 343/700 MS

* cited by examiner

WIDEBAND ANTENNA DEVICE WITH EXTENDED GROUND PLANE IN A PORTABLE DEVICE

RELATED APPLICATIONS

The present application is a 35 U.S.C. §371 national phase application of PCT International Application No. PCT/EP03/006109, having an international filing date of Jun. 11, 2003 and claiming priority to European Patent Application No. 02013085.2, filed Jun. 13, 2002, European Patent Application No. 02018940.3, filed Aug. 26, 2002 and U.S. Provisional Application No. 60/407,886 filed Sep. 3, 2002, the disclosures of which are incorporated herein by reference in their entireties. The above PCT International Application was published in the English language and has International Publication No. WO 03/107473.

FIELD OF THE INVENTION

The present invention relates to an antenna device for use in a small portable device. More specifically, the invention relates to a wideband antenna having sufficient efficiency for meeting the requirements of different communications protocols. Also, the antenna reduces the power consumption of the small portable device so it can operate longer on a small battery.

BACKGROUND OF THE INVENTION

Examples of a small portable device is e.g. a headset for wireless communication through an antenna with a mobile communication apparatus, such as a mobile telephone, a Bluetooth device, or any portable or stationary electronic device. A small portable device is, as indicated, characterized in that it is small and light. Therefore, it is preferred if the antenna used in such a device is small, light, and efficient. The small portable device may communicate using a communication protocol, such as the Bluetooth, the WLAN (Wireless Local Area Network), the UMTS (Universal Mobile Telecommunications System), or the GSM (Global System for Mobile communications) protocol.

One example of an antenna for a small portable device is a monopole antenna, which extends out of the product. Another solution is a PIFA (Planar Inverted F Antenna) antenna. However, there are several drawbacks of these antennas. To achieve sufficient bandwidth to meet the requirements of known communication protocols, e.g. according to above, the known antennas all need ground planes, which are too big to fit in a small portable device.

There are a number of problems with the known prior art-antennas, which make them unsuitable for use in a small portable device.

Firstly, the size of the small portable device causes problems for the antenna design, as it entails limited battery capacity. This means that the antenna should have a high efficiency in order not to waste battery power. Small antennas have lower efficiency than big antennas. As the device is small, the ground plane will also be small. An antenna requires a certain ground plane size to achieve a certain bandwidth, which is necessary for the antenna to be able to operate under a specific communications protocol, which always requires a certain bandwidth.

Secondly, since cost is often important for a small portable device it is important that the antenna can be made cheaply, which is not always the case with the antennas known in the art.

Thirdly, because of the small nature of the small portable device, other parts of the device will be very close to the antenna, which can have a negative influence on the antenna performance. Especially conducting materials like batteries, knobs or ESD (electrostatic discharge) means can have a very negative influence on the antenna performance. Therefore, the antenna has to work well in this environment, which is also not possible with the antennas according to the known prior art.

SUMMARY OF THE INVENTION

Therefore, the object of the present invention is to provide an antenna device, which is sufficiently small to fit in small portable devices and which has efficiency and bandwidth to meet requirements of known and future communications protocols.

The above objects are achieved by an antenna device for a portable device, which comprises a folded antenna loop of conducting material having first and second ends to be connected to radio frequency (RF) circuitry and a ground plane of a PCB, respectively. Further, the antenna device comprises a ground plane extender positioned in the extension of a first side of the PCB. In one embodiment of the invention, the antenna extender is at least one battery casing of a battery cell having a position to serve as an extension of the ground plane of the PCB.

The antenna loop comprises first and second connectors provided at a second side of the PCB for connecting the antenna loop to the RF circuitry and the ground plane of the PCB, respectively.

Further, the antenna loop comprises:

a first portion having a first and a second end, said portion extending in a first direction along a third side of the PCB, the first end being connected to the RF circuitry of the PCB;

a second portion having a first and a second end, the first end of the second portion being connected to the second end of the first portion, said second portion extending in a second direction from the third side of the PCB towards a fourth side of the PCB, which is opposite the said third side; and a third portion having a first and a second end, the first end of the third portion being connected to the second end of the second portion and the second end of the third portion being connected to the ground plane of the PCB, said third portion extending in the direction opposite to said first direction along said fourth side of the PCB.

In one embodiment, the PCB of the antenna device is a multi layer PCB having one layer used as a dedicated RF ground plane, which also serves as the ground plane of the antenna device. The antenna loop is positioned opposite a first or a second surface of the PCB.

The material of the antenna loop is any well conducting material, such as metal. In an alternative embodiment, the antenna loop is provided as a U-shaped dielectric having the antenna shape etched into the dielectric. Still another embodiment is to provide the antenna loop inside the PCB as an element thereof.

Additionally, the antenna device may be provided with a bezel, which is connected to the PCB, for fending off ESD (Electrostatic Discharges) discharges. The bezel extends from the third side of the PCB towards the fourth side of the PCB. Also, to improve ESD robustness, the antenna device may be provided with bezel flanges connected to the ground plane of the PCB, which extends along the third and fourth sides of said PCB.

A further object of the invention is to provide an PCB comprising an antenna device, which is sufficiently small to fit in small portable devices, and which has good performance to meet requirements of communications protocols.

The above objects are achieved by a multi-layer printed circuit board (PCB) comprising an antenna device according to the above.

Finally, it is an object of the invention to provide a portable communication device having an antenna with good performance and being sufficiently small to fit into a small portable device. The efficiency of the antenna device should be high to keep the power consumption low. As should be noticed, it is a further important object of the antenna according to the invention to provide high bandwidth to meet said requirements of communication protocols.

A portable device comprising the antenna device according to above achieves the above objects. In one embodiment, the portable communication device is a headset.

An advantage of an antenna device according to the present invention is that it is sufficiently small to fit into small portable devices and still provides good efficiency and high bandwidth. Therefore, the antenna device can be adapted to meet requirements of several different communications protocols. Also, as the PCB of the antenna device may be decreased, the weight and the cost of the antenna device are also decreased.

Further preferred features of the invention are defined in the dependent claims.

It should be emphasized that the term "comprises/comprising" when used in this specification is taken to specify the presence of stated features, integers, steps, components or groups thereof.

BRIEF DESCRIPTION OF THE DRAWINGS

A preferred and alternative embodiments of the present invention will be described in the following detailed disclosure, reference being made to the accompanying drawings, in which.

DETAILED DESCRIPTION OF EMBODIMENTS OF THE INVENTION

Figure 1:
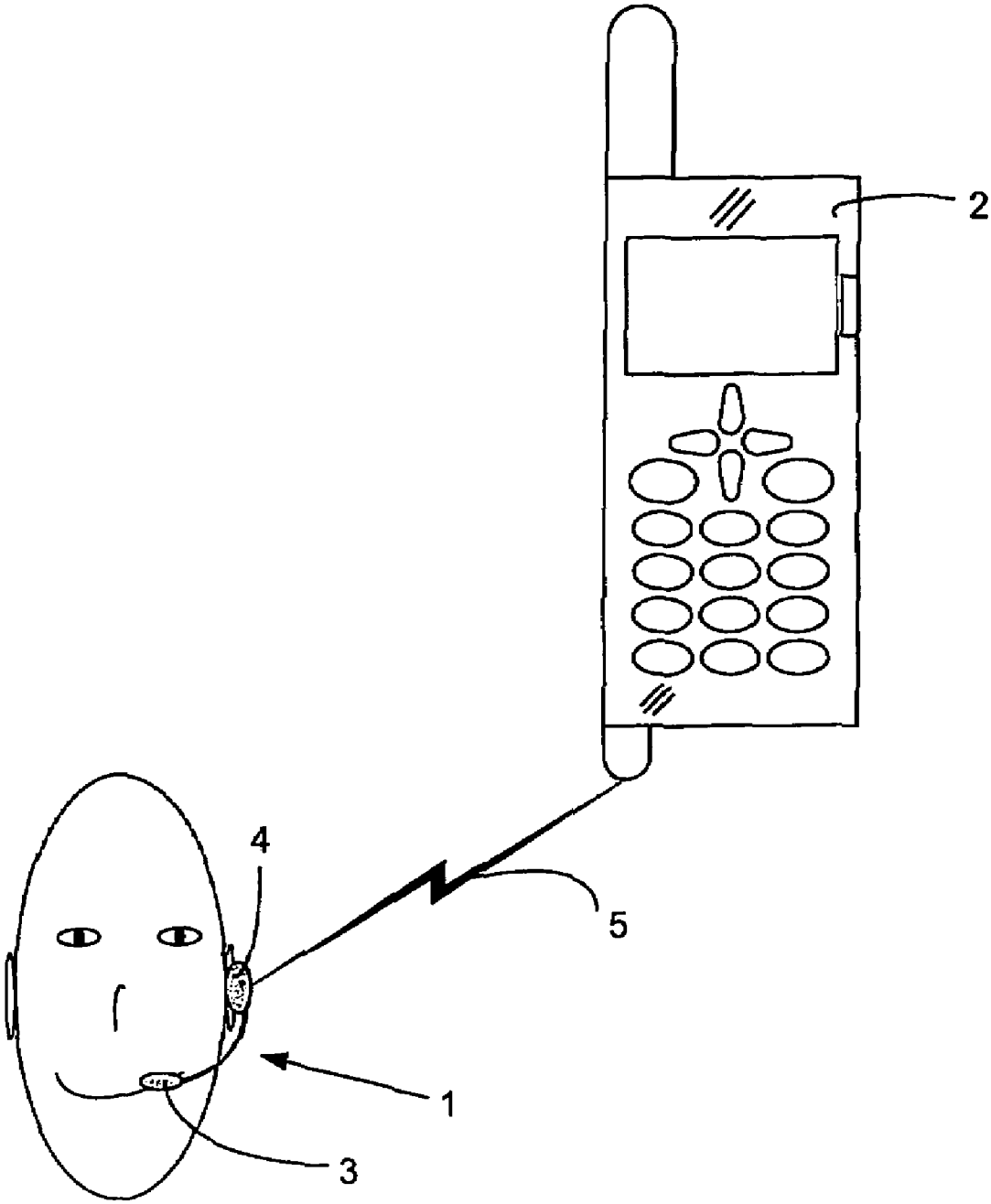
FIG. 1 illustrates a small portable device embodied as a headset.

In FIG. 1 is a small portable communication device illustrated as a headset 1, which is adapted for wireless communication with a mobile telephone 2. The small portable device could be any electronic communication device, which has to be small to meet user preferences and which is adapted to communicate wirelessly with another communication device, which may be stationary or portable.

In the following, reference will be made to a headset 1 and a mobile telephone 2. However, this is only for convenience and the illustrated headset 1 and mobile telephone 2 are only for exemplifying purposes and should not be taken as limiting the scope of the invention.

The headset 1 comprises a microphone 3 and a loudspeaker 4, through which a user of the headset 1 may receive and transmit speech to the mobile telephone 2 through a wireless connection 5. Also, it is equally possible to communicate any data between the small portable device and the mobile telephone 2.

Figure 2:
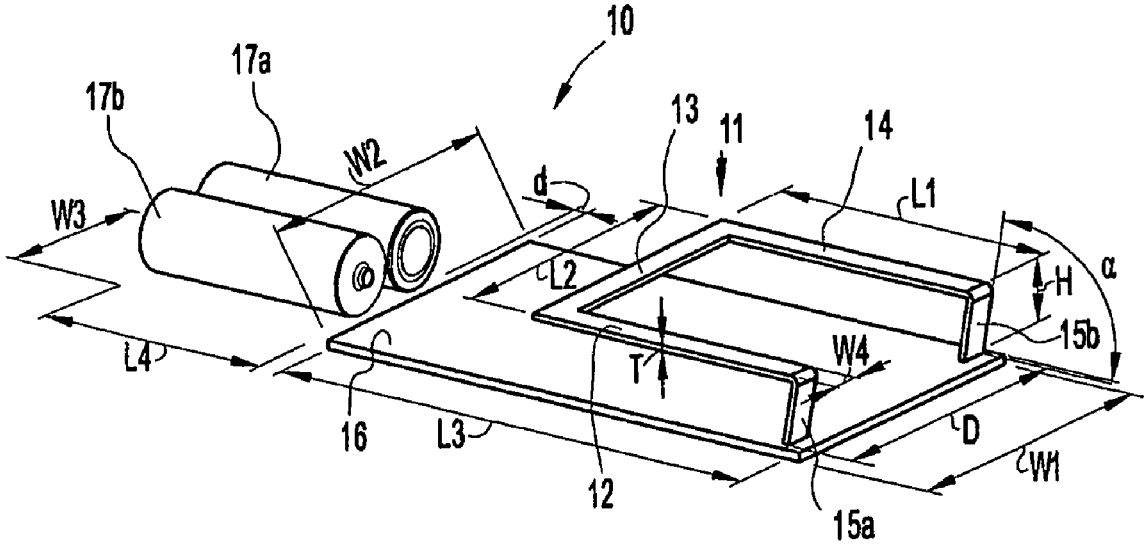
FIG. 2 shows a general embodiment of the antenna device according to the invention.

In FIG. 2 a first general embodiment of an antenna device 10 according to the invention is shown, which may be positioned in the proximity of the loudspeaker 4 of FIG. 1. The antenna device 10 comprises a half-wave folded antenna loop 11 having first 12, second 13, and third 14 portions, respectively, each having a first and a second end. A first connector 15*a* is connected to the first end of the first portion 12, and a second connector 15*b* is connected to the second end of the third portion 14. The first end of the second portion 13 is connected to the second end of the first portion 12, and the second end of the second portion 13 is connected to the first end of the third portion 14. In FIG. 2, the antenna loop 11 is provided opposite a first front surface of the PCB 16. However, the antenna loop 11 may equally be positioned opposite a second rearwardly facing surface of the PCB 16.

The antenna loop 11 is connected, through the connectors 15*a*, 15*b*, to radio circuitry and a ground plane within the PCB 16, respectively. The PCB 16 can be made out of any known PCB, as long as one layer is used as a dedicated RF (Radio Frequency) ground plane, which also serves as the ground plane of the antenna device 10. The connectors may be a part of the antenna loop 11 connected to the PCB 16 via holes provided in the PCB. The connectors may be provided at an angle $\alpha$ in relation antenna loop 11 and the PCB 16. This will shorten the total length of the antenna device compared to if the angle $\alpha$ is 90°. If the connectors are provided essentially perpendicular to the PCB 16, the total length of the antenna is longer. However, if the connectors are folded with the angle $\alpha$ the antenna solution is made shorter without effecting the antenna performance.

Batteries 17*a*, 17*b* are positioned at a first side of the PCB 16. The position of the batteries 17*a*, 17*b* in relation to the PCB 16 and the connectors 15*a*, 15*b* is important for the performance of the antenna device 10, as will be further explained below. In FIG. 2, two batteries 17*a*, 17*b* are shown. However, any suitable number of batteries may be utilized, depending on the actual configuration. The batteries 17*a*, 17*b* can be of any configuration, technology or size suitable with the headset 1, as long as they are provided in a battery casing.

The antenna device 10 is a loop antenna, wherein the antenna loop 11 is made out of a metal, such as copper. However, any well conducting material can be used. As an alternative embodiment, the antenna loop could be provided as a loop on one layer of a multi-layer PCB 16. Still another embodiment is to provide the antenna loop 11 as a component formed as a U-shaped dielectric with the antenna loop etched into it (like a thick PCB), making it suitable for SMT (Surface Mounted Technology) pick and place machines. As is shown in FIG. 2, the first connector 15*a* is connected to the PCB at a second side thereof, which is opposite the first side of the PCB 16.

The first portion 12 extends along a third side of the PCB 16 towards the first side of the PCB. The second portion 13 extends from the second end of the first portion 12 towards a fourth side of the PCB 16. Finally, the third portion 14 extends from the second end of the second portion 13 along the fourth side of the PCB 16 towards the second antenna connector 15*b*, which is connected to the PCB 16 at the second side thereof.

Figure 3:
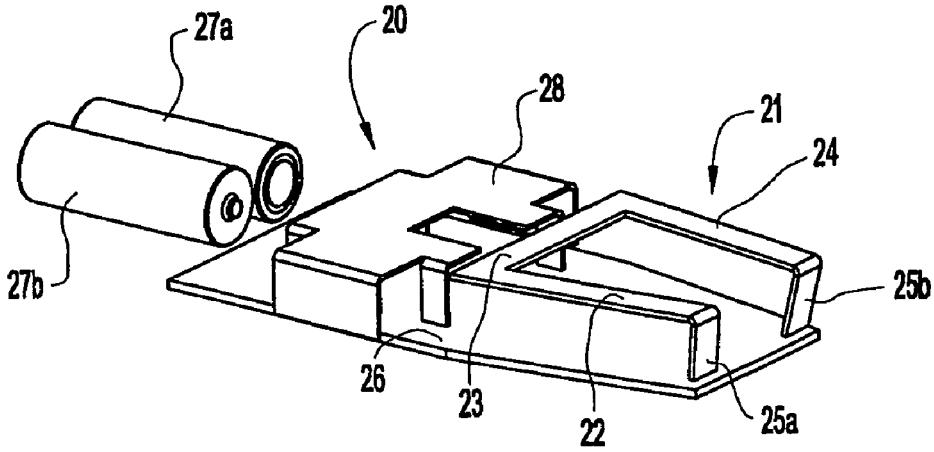
FIG. 3 shows a second embodiment of the antenna device according to the invention.

The shape of the antenna loop 11 is not fixed, as can be seen from a second embodiment shown in FIG. 3. Like numerals of FIG. 3 correspond to like numerals of FIG. 2. Consequently, the antenna connectors 15*a*, 15*b* of FIG. 2 correspond to antenna connectors 25*a*, 25*b* of FIG. 3, the antenna loop 11 of FIG. 2 corresponds to an antenna loop 21 of FIG. 3 etc. As is illustrated in FIG. 3, the angle between the first portion 22 and the second portion 23, respectively, is less than 90 degrees. The same applies for the angle between the second and third portions 23, 24. However, the angles may be more than 90 degrees (not shown). Further, the first 23 and third 24 portions do not have to be straight, but can be folded. Consequently, the exact design of the antenna loop 11, 21 is not fixed, and has to be thoroughly tested and evaluated in each specific case.

The second embodiment of the antenna device 20 shown in FIG. 2 comprises a bezel 28. The bezel 28 is provided between the antenna loop 21 and the batteries 27*a*, 27*b*, and is connected to the PCB 26. The bezel 28 is optional and utilized for fending off ESD (Electrostatic Discharge) discharges. The bezel extends from the third side of the PCB 26 towards the fourth side of the PCB 26. In the second embodiment it is made of a metal sheet, but can be made of any well conducting material.

Figure 4:
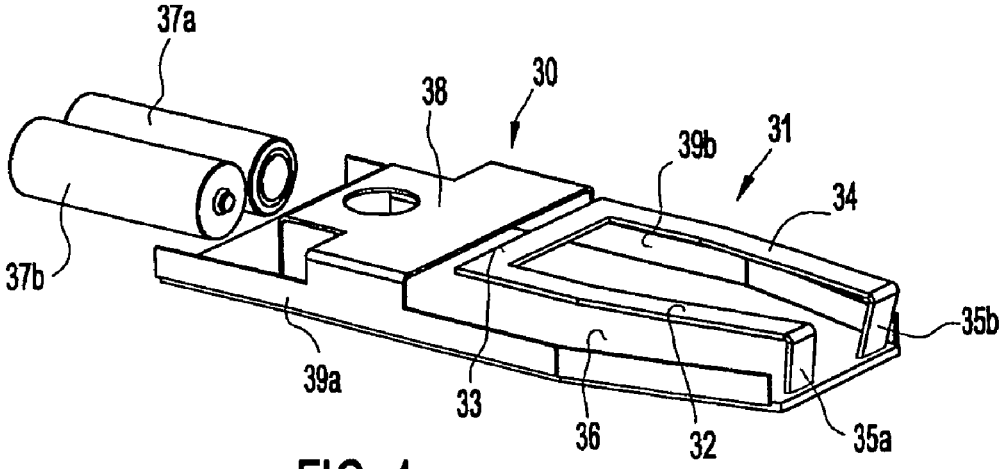
FIG. 4 shows a third embodiment of the antenna device according to the invention.

In FIG. 4 a third embodiment of the invention is shown. Like numerals in FIG. 4 correspond to like numerals of FIG. 2 according to the same pattern as was described in relation to FIG. 3. In the third embodiment, the bezel 38 is provided with bezel flanges 39*a*, 39*b* extending along the third and fourth sides of the PCB 36. The bezel flanges 39*a*, 39*b* are, via the bezel 38, also connected to the PCB 36 and improves ESD robustness without influencing the antenna performance negatively. As should be noticed, the bezel flanges 39*a*, 39*b* may be provided without the bezel 38.

To extend the ground plane of the PCB 16, 26, 36 a ground plane extender is provided in the extension of the first side of the PCB. Any well conducting material will function as the extender. The battery cell provided in a battery casing made of a conducting material, such as metal, may provide the ground plane extender. Consequently, the batteries 17*a*, 17*b*, 27*a*, 27*b*, 37*a*, 37*b* will act as an extension of the ground plane of the PCB 16, 26, 36 if they are positioned in the extension of the first side of the PCB 16, 26, 36, which is opposite the second side where the connectors 15*a*, 15*b*, 25*a*, 25*b*, 35*a* 35*b* are connected to the PCB 16, 26, 36.

The position of the at least one battery 17*a*, 17*b*, 27*a*, 27*b*, 37*a*, 37*b* is important for the antenna performance. Although the batteries 17*a*, 17*b*, 27*a*, 27*b*, 37*a*, 37*b* are not directly connected to the ground plane of the PCB 16, 26, 36 they will act together with the ground plane of the PCB to form an extended ground plane, which is larger than the actual ground plane of the PCB. Therefore, the antenna loop 11, 21, 31 will experience a ground plane which is sufficiently large without actually providing a ground plane having an actual size to achieve a certain bandwidth to meet requirements of a certain communications protocol. Consequently, the PCB 16, 26, 36 may be decreased if the batteries 17*a*, 17*b*, 27*a*, 27*b*, 37*a*, 37*b* are provided in a position for extending the ground plane. Therefore, the dimensioning of the antenna and the small portable device can be made small, and light.

The distance d between the PCB 16, 26, 36 and the batteries 17*a*, 17*b*, 27*a*, 27*b*, 37*a*, 37*b* is approximately about 1 mm in the shown embodiments. However, the distance d has to be tested and evaluated in each specific case.

A further tuning parameter of the antenna device 10, 20, 30 is that the connectors 15*a*, 15*b*, 25*a*, 25*b*, 35*a* 35*b* should preferably be provided as close as possible to the edge of the second side of the PCB 16, 26, 36. The closer the connectors 15*a*, 15*b*, 25*a*, 25*b*, 35*a* 35*b* are to the edge of the second side of the PCB 16, 26, 36, the more bandwidth is gained. Similarly, the first and second portions 12, 22, 32, 13, 23, 33 of the antenna loop, respectively, should preferably be provided as close as possible to the third and fourth side of the PCB 16, 26, 36, respectively. The closer said portions are to the third and fourth sides of the PCB, the more bandwidth is gained.

The antenna design according to the invention is sufficiently efficient to be adapted for communicating according to several protocols, such as Bluetooth, WLAN, GSM, UMTS, ISM etc. There are a number of tuning parameters for adapting the antenna to a specific protocol, such as the length of the antenna loop 11 (half wave antenna loop), the length L1 of the first and third portions 12, 14, respectively, the length L2 of the second portion 13, the length L3 and width W1, W2 of the PCB 16, the length L4 and width W3 of the batteries 17*a*, 17*b*, the height H of the antenna loop 11 above the PCB 16, the distance D between the connectors 15*a*, 15*b*, the thickness T of the antenna loop 11, the distance d between the PCB 16 and the batteries 17*a*, 17*b*, the angle α between the first and third portions 12, 14 and the connectors 15*a*, 15*b*, as is indicated in FIG. 2.

A preferred thickness of the antenna loop is about 0.1-1 mm.

The embodiment shown in FIG. 3 is adapted for communication according to the Bluetooth protocol, wherein the center frequency is around 2,4-2,5 GHz, and has the following approximate dimensions:

| | |
|---|---|
| L1 | 22 mm |
| L2 | 13.4 mm |
| L3 | 38 mm |
| L4 | 20 mm |
| W1 | 10 mm |
| W2 | 16 mm |
| W3 | 16.5 mm (together) |
| D | 7.5 mm |
| T | 0.1-1 mm |
| W4 | 2.3 mm |
| H | 5.1 mm |
| d | 1 mm |
| α | 50° |

Figure 5:
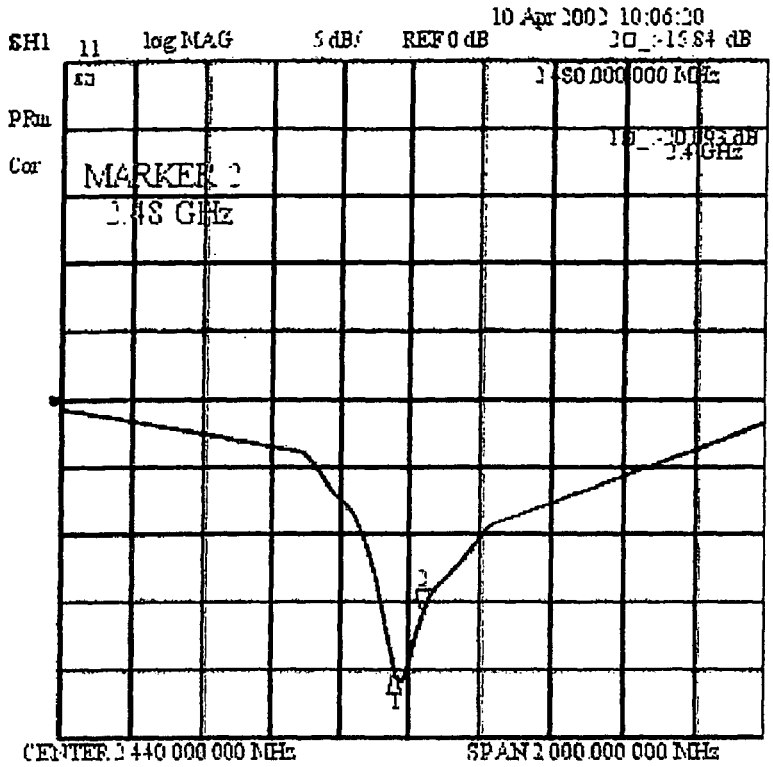
FIG. 5 shows a mag-log diagram of a measurement made on a prototype of the embodiment of FIG. 3.
Figure 6:
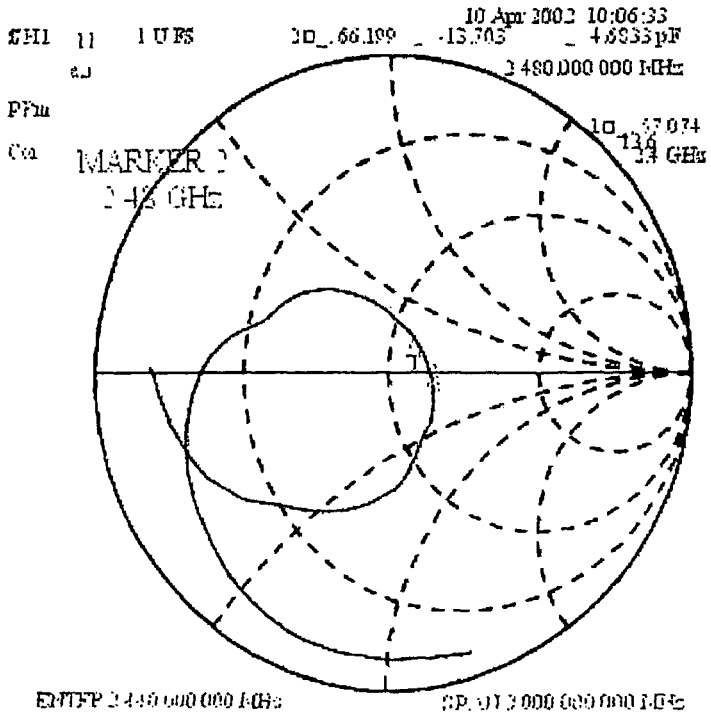
FIG. 6 shows a Smith chart of a measurement made on a prototype of the embodiment of FIG. 3.

In FIG. 5 a log-mag diagram and in FIG. 6 a Smith chart of a measurement made on a prototype of the embodiment of FIG. 3 are shown. The measurement is made with a human body behind the antenna device in order to make the measurement as realistic as possible. From FIG. 5 and FIG. 6 of a measurement made on a prototype of the embodiment of FIG. 3 it can be concluded that the antenna device shows good performance, meeting the bandwidth requirements of the Bluetooth protocol.

If the height H is increased, bandwidth is gained. However, with an increased height H the antenna will be more sensitive to the environment, such as the microphone 3, the loudspeaker 4, the user of the headset 1, and other electronic components of the headset, and vice versa. Also, in alternative embodiments the first, second and third portions of the antenna loop may be provided in different planes. Each portion can be provided in a different plane if preferred.

As should be noted, the antenna has an input impedance of 50 ohm, and therefore no impedance matching circuits are needed to match the antenna to the RF circuitry of the PCB.

The present invention has been described with reference to a few alternative embodiments. However, the embodiments are only for exemplifying purposes and should not be taken as limiting the scope of the invention, which is best defined by the appended independent claims. All dimensions of the antenna device according to the invention have to be thoroughly tested and evaluated in each specific case. Further, the invention has been described in relation to a headset. However, the invention can be adapted to and utilized in any small portable device. Also, the antenna device can be used in other portable devices, such as mobile telephones, mobile terminals, smartphones, or the like, where a small and efficient antenna design is preferred.

The invention claimed is:

1. An antenna device for a portable device, the antenna device comprising an antenna loop of conducting material having first and second ends connected to a radio frequency (RF) circuitry and a ground plane of a printed circuit board (PCB), respectively, the antenna loop being positioned opposite the ground plane; and a ground plane extender positioned at a first side of the PCB and in a longitudinal extension of the ground plane, wherein the ground plane extender is a separate piece and spaced apart a distance from the ground plane.

2. The antenna device according to claim 1, wherein the antenna loop comprises first and second connectors provided at a second side of the PCB configured to connect the first and second ends of the antenna loop to the RE circuitry and the ground plane of the PCB, respectively.

3. The antenna device according to claim 2, wherein the antenna loop further comprises:

a first portion having a first and a second end, the first portion extending in a first direction along a third side of the PCB, the first end of the first portion being connected to the RF circuitry of the PCB;

a second portion having a first and a second end, the first end of the second portion being connected to the second end of the first portion, the second portion extending in a second direction from the third side of the PCB towards a fourth side thereof, which is opposite the third side; and a third portion having a first and a second end, the first end of the third portion being connected to the second end of the second portion and the second end of the third portion being connected to the ground plane of the PCB, the third portion extending in the opposite direction of the first direction along the fourth side of the PCB.

4. The antenna device according to claim 1, wherein the PCB is a multi-layer PCB having one layer configured as a dedicated RF ground plane that provides the ground plane of the antenna device.

5. The antenna device according to claim 4, wherein the antenna loop is provided inside the PCB.

6. The antenna device according to claim 1, wherein the ground plane extender is at least one battery casing of a battery cell, the at least one battery casing being positioned in the longitudinal-extension of the ground plane of the PCB.

7. The antenna device according to claim 1, wherein the antenna loop is positioned opposite a first or a second surface of the PCB.

8. The antenna according to claim 7, further comprising a U-shaped dielectric having the antenna loop-etched into the dielectric.

9. The antenna device according to claim 1, wherein the conducting material of the antenna loop is metal.

10. The loop antenna device according to claim 1, wherein the ground plane extender is a battery casing.

11. The loop antenna device according to claim 1, wherein the first and second ends of the antenna loop comprise a planar portion configured to directly contact the radio frequency (RF) circuitry and the ground plane of the printed circuit board (PCB).

12. The loop antenna device according to claim 1, wherein the first and second ends of the antenna loop are directly connected to the radio frequency (RF) circuitry and the ground plane of the printed circuit board (PCB).

13. The loop antenna device according to claim 1, wherein the ground plane extender is not in direct contact with the ground plane of the printed circuit board (PCB).

14. The loop antenna device according to claim 1, wherein the ground plane extender and the ground plane of the printed circuit board (PCB) together form an extended ground plane that is larger than the ground plane of the printed circuit board (PCB).

15. The loop antenna device according to claim 1, wherein the first and second ends of the antenna loop are connected to the printed circuit board (PCB) at a second side thereof that is opposite the first side of the PCB and the ground plane extender.

16. The loop antenna device according to claim 1, wherein the distance between the ground plane extender and the ground plane is about 1 mm.

17. An antenna device for a portable device, the antenna device comprising an antenna loop of conducting material having first and second ends connected to a radio frequency (RE) circuitry and a ground plane of a printed circuit board (PCB), respectively, the antenna loop being positioned opposite the ground plane; and a ground plane extender positioned at a first side of the PCB and in a longitudinal extension of the ground plane, wherein the PCB further comprises a second side opposite the first side, a third side adjacent the first and second sides, and a fourth side opposite the third side, the antenna device further comprising a bezel connected to the PCB that extends from the third side of the PCB towards the fourth side of the PCB, and/or bezel flanges connected to the ground plane and extending along the third and fourth sides of the PCB.

18. A multi-layer printed circuit board (PCB) comprising:

a radio frequency (RF) circuitry and a ground plane on the PCB;

an antenna device connected to the PCB, the antenna device comprising:

an antenna loop of conducting material having first and second ends connected to the radio frequency (RF) circuitry and the ground plane of the PCB, respectively, the antenna loop being positioned opposite the ground plane; and a ground plane extender positioned at a first side of the PCB and in a longitudinal extension of the ground plane, wherein the ground plane extender is a separate piece and spaced apart a distance from the ground plane.

19. A portable communication device comprising:

a printed circuit board (PCB) comprising a radio frequency (RF) circuitry and a ground plane;

an antenna device connected to the PCB, the antenna device comprising:

an antenna loop of conducting material having first and second ends connected to the radio frequency (RE) circuitry and the ground plane of the PCB, respectively, the antenna loop being positioned opposite the ground plane; and a ground plane extender positioned at a first side of the PCB and in a longitudinal extension of the ground plane, wherein the ground plane extender is a separate piece and spaced apart a distance from the ground plane.

20. The portable communication device according to claim 19, wherein the portable communication device is a headset.

* * * * *

UNITED STATES PATENT AND TRADEMARK OFFICE

CERTIFICATE OF CORRECTION

PATENT NO. : 7,319,433 B2
APPLICATION NO. : 10/517902
DATED : January 15, 2008
INVENTOR(S) : Rosenberg et al.

It is certified that error appears in the above-identified patent and that said Letters Patent is hereby corrected as shown below:

In the claims:

Column 7, Claim 2, Line 32: Please correct "RE" to read -- RF --

Column 8, Claim 17, Line 36: Please correct "(RE)" to read -- (RF) --

Column 9, Claim 19, Line 4: Please correct "(RE)" to read -- (RF) --

Signed and Sealed this

Seventeenth Day of June, 2008

JON W. DUDAS
*Director of the United States Patent and Trademark Office*